US005842565A

United States Patent [19]

Hagaman

[11] Patent Number: 5,842,565

[45] Date of Patent: Dec. 1, 1998

[54] GOLF BAG FOR ORIENTING INCLINED GOLF CLUBS

[76] Inventor: Smith McCartney Hagaman, 3439 Country Club Rd., Winston-Salem, N.C. 27104

[21] Appl. No.: 779,163

[22] Filed: Jan. 6, 1997

[51] Int. Cl.[6] ..... A63B 55/00

[52] U.S. Cl. ..... 206/315.3; 206/315.5; 206/315.6

[58] Field of Search ..... 206/315.2–315.8

[56] References Cited

U.S. PATENT DOCUMENTS

| | | | |
|---|---|---|---|
| Re. 33,203 | 4/1990 | Reimers . | |
| 951,448 | 3/1910 | O'Neil | 206/315.5 |
| 1,092,729 | 4/1914 | Low et al. | 206/315.5 |
| 1,189,879 | 7/1916 | Shamberg | 206/315.6 |
| 1,409,323 | 3/1922 | Wells | 206/315.5 |
| 1,632,442 | 6/1927 | Grubb | 206/315.6 |
| 2,482,372 | 9/1949 | Rossow | 206/315.2 |
| 2,685,317 | 8/1954 | Lace et al. | 206/315.6 |
| 3,164,185 | 1/1965 | Ingoldt | 206/315.2 X |
| 4,012,051 | 3/1977 | Embinder | 206/315.4 X |
| 4,311,178 | 1/1982 | Kennedy . | |
| 4,383,563 | 5/1983 | Kirchhoff, Jr. . | |
| 4,673,082 | 6/1987 | Hemme . | |
| 4,905,827 | 3/1990 | Kim . | |
| 5,071,147 | 12/1991 | Stansbury | 206/315.2 X |
| 5,094,500 | 3/1992 | Maypole et al. . | |
| 5,123,531 | 6/1992 | Beretta . | |
| 5,125,507 | 6/1992 | Graziano, Jr. . | |
| 5,215,194 | 6/1993 | Blanford et al. . | |
| 5,226,533 | 7/1993 | Antonious | 206/315.6 |
| 5,314,079 | 5/1994 | Young . | |
| 5,447,228 | 9/1995 | Hodgson, III . | |
| 5,465,839 | 11/1995 | Gretz . | |
| 5,518,113 | 5/1996 | Boone . | |
| 5,544,743 | 8/1996 | Hong . | |

FOREIGN PATENT DOCUMENTS

| | | | |
|---|---|---|---|
| 214555 | 8/1967 | Sweden | 206/315.5 |
| 9216266 | 10/1992 | WIPO | 206/315.3 |

OTHER PUBLICATIONS

OGIO International 1997 Catalog , p. 2.

LaMarque Golf Carts ©1996 (http://www.choicemall.com).

*Primary Examiner*—Sue A. Weaver

*Attorney, Agent, or Firm*—Robert W. Pitts

[57] ABSTRACT

A golf bag having at least one internal storage compartment for storing golf clubs in an inclined orientation when the golf bag is in an upright position is especially adapted for use with a powered golf cart. One embodiment of the bag has a rectangular cross section with front and back club compartments separated by an inclined divider wall extending from the base of the bag to the top. An auxiliary storage compartment is located on the front of this rectangular bag and need not protrude from the bag. The front of the bag is shorter for easier club access and a handle for positioning the bag on a golf cart is located on the shorter side. Longer clubs are placed in a rear compartment parallel to the row of shorter clubs in the front compartment, and each clubhead faces the front of the bag. A second embodiment has a circular cross section with a tapered insert at the base of the bag and a central obstruction at the top so that all of the clubs are tilted radially outward.

17 Claims, 4 Drawing Sheets

38
34
13B
36
4B
40
13A
11B
10
9
11A
32
2
40
8
28
4A
4
30
42
44
44
44
6

GOLF BAG FOR ORIENTING INCLINED GOLF CLUBS

BACKGROUND OF THE INVENTION

1. Field of the Invention

This invention is related to a golf bag for use with a full set of golf clubs and is more particularly related to a golf bag specifically intended for use with a conventional powered golf cart.

2. Description of the Prior Art

Golfers can be divided into a number of categories, but one distinction between two groups of golfers is that some golfers walk and some golfers ride powered golf carts. Although some golfers walk on some occasions and ride on others, many golfers always ride conventional powered golf carts. Indeed many senior golfers are unable to walk for a complete round and must always ride. Some golf courses also require that golfers ride, at least in part because of the revenue generated by golf cart rental.

Traditionally golf bags have been suited for either the walking golfer who carries his clubs himself, uses a pull cart or on even rarer occasions uses a caddy, or for the golfer who uses a golf cart. Golf bags have progressed from the small cloth carry bags that were used by the historic links golfer to rectangular bags, that while larger were still relatively easy to carry. Modern larger bags have cylindrical bases and protruding pockets and storage compartments. While these larger bags could be carried, they tended to be quite heavy, especially considering the number of items that could be carried, and therefore are carried. In recent years, smaller carry bags with integral stands have become popular with the walking golfer.

Conventional golf bags have however been suitable or at least adaptable for use by the walking golfer and by the riding golfer. However, since many golfers always ride powered carts, bags that can be carried by walking golfers have inevitably represented compromises. These multi-purpose bags have failed to achieve all of the advantages that could be realized by a golf bag that is intended solely for use on a powered golf cart. For example a bag, such as in the instant invention could incline the clubs for easier access and to permit the club heads to all be in alignment. A bag intended only for used with a cart could also be rectangular in cross section to use all of the space available on the rear of a conventional electric or gas powered golf cart. Furthermore a bag intended solely for use with a golf cart could always position the shorter clubs so that they would be in the front with longer clubs in the rear.

The following patents represent conventional golf bags that might be used for both the walking and riding golfers or are not specifically adapted to achieve all of the advantages of a golf bag intended only for use with a golf cart, including especially easier access to the golf clubs.

U.S. Pat. No. 4,311,178 shows full length interior dividers for use in a golf bag. The dividers do not appear to be inclined relative to the base of the bag or to the vertical axis of the bag and they are used with a bag having a circular cross section.

U.S. Pat. No. 4,673,082 shows a golf bag having a rotating club carrier. Although the exterior bag can have a square cross section, this square cross section does not related to the storage or the positioning of the golf clubs. Auxiliary storage space is still provided by an external pocket.

U.S. Pat. No. 4,905,827 shows a golf bag having a generally rectangular club storage area. The external cross section of the bag is generally hexagonal. The internal club storage area is separated by dowels that function as conventional dividers. These dividers do not appear to divide the club storage area into longitudinally extending compartments and do not divide the club storage area into sloping compartments. Auxiliary storage is provided by protruding compartments located along the ends of the bag and not along the side of the bag.

U.S. Pat. No. 5,123,531 addresses the problem of club presentation when the bag is positioned on the rear of a golf cart. This bag has a cuff sloping downwardly from the back of the bag toward the front at the top of the golf bag. Rods separate the interior of the bag into three compartments. This bag has a circular cross section with external auxiliary storage and the interior compartments are not sloping. This bag does have a handle located at the back of the bag where it faces outwardly when mounted on a golf cart.

U.S. Pat. No. 5,125,507 shows a golf bag having two rows of openings in a V-shaped configuration. This bag is intended to position the clubs so that they are easy to select, but does not appear to be especially adapted for use on a golf cart. Indeed this bag would appear to be very awkward when used on a golf cart.

U.S. Pat. No. 5,215,194 shows a golf bag in which the clubs can be advantageously positioned in a powered golf cart and in a pull cart with the shorter clubs facing outwardly. This golf bag also includes exterior storage pockets on opposite sides of the golf bag that also face outwardly when the bag is positioned on a powered or a pull cart. This bag does not have a rectangular cross section and does not include sloping interior compartments.

U.S. Pat. No. 5,447,228 shows a golf bag that includes a liner and an upper collar that can be position in two alternate positions rotated 180° apart so that the clubs can be positioned for proper presentation when the bag is mounted on a golf cart. When the liner and collar are reversed, the bag is in the proper carrying position for a walking golfer or a caddy. Separate full length club compartments are formed, but these compartments do not slope relative to the base or vertical axis of the bag. The liner has a circular cross section and two parallel rectangular compartments are not formed.

U.S. Pat. No. 5,465,839 shows a golf bag that is formed using a plurality of interfitting rectangular compartments. Each club is positioned in only one rectangular compartment and three rows of parallel compartments are formed. These compartments are not sloped and are not oriented so that the clubs can be positioned on a golf cart with the smaller clubs facing outward. Auxiliary storage is provided in exterior compartments and this bag provides no advantages when positioned on a golf cart.

U.S. Pat. No. 5,518,113 shows a golf bag in which the main club compartment has two parallel sides. Golf clubs are separated by a divider top which is intended to separate the clubs to retain a proper weight distribution. This bag does not appear to offer any advantages when the bag is positioned on a golf cart.

U.S. Reissue Pat. No. 33,203 shows a golf bag in which the axis of the compartments is inclined relative to vertical. Each club compartment does extend for the full length of the bag. However, the base of this golf bag is not horizontal and the longitudinal axis of the golf bag does not extend vertically. This bag is not intended to be positioned vertically because it is a carry bag that is not adapted for use with a cart, either a powered cart or pull cart. Indeed, it would not be easy to use this bag with a powered cart.

SUMMARY OF THE INVENTION

This invention is for a golf bag that is intended for use with a powered golf cart in which the bag is positioned on the rear of the golf cart. This golf bag is specifically intended for use on a conventional golf cart on which two bags are upright and side by side.

As shown in the accompanying drawings, the preferred embodiment of the bag has a rectangular cross section and is divided into two rectangular compartments in which golf clubs would be carried in the standard inverted position and at least one supplemental or auxiliary equipment storage compartment for golf balls, shoes and other equipment. The depth of the golf bag is equal to the diameter of the circular base of a conventional golf bag. The width of the bag can be greater than its depth since all of the auxiliary storage is located within the rectangular cross section and no allowance need be made for protruding storage areas. The flat sides of the bag offer attractive locations for logos and brand name advertising and can also be used to enhance the golfer's pride of ownership by displaying his name in much the same way as a professional golfer.

The rectangular interior golf club compartments are formed by two interior walls. Both of these interior walls are inclined at an acute angle relative to the base of the golf bag so that each wall slopes from the rear of the bag at its base toward the front of the bag at the top. When the bag is positioned in an upright position on a powered golf cart, the clubs will be inclined relative to the vertical. As seen from the side when the bag is mounted on a cart, barriers at the top are located closer to the front of the bag than the intersection between the inclined compartment dividers and the base of the golf bag. This factor combined with the slope of the club compartment assures that clubs must be slanted when the bag sits upright. This inclination has at least two advantages. First, the clubs can be more easily inserted into and removed from the bag. Second, the club heads will tend to be oriented toward the rear when placed on a golf cart. Iron clubs positioned side by side in this manner will naturally tend to be mutually aligned because of the sloping nature of the club faces. Each of the two rectangular club storage compartments can include separators extending perpendicular to the front and rear of the bag. In use, clubs tend to become entangled in a conventional golf bag. In this bag, the lateral tangle is inhibited by these separators. The fore and aft tangle is inhibited by the club shafts lying parallel and the club heads hanging parallel. The barriers at the top of the golf bag can also form the front walls of secondary storage compartments extending between rows of clubs.

The rectangular cross section of the bag in conjunction with the sloping interior walls creates a large tapered auxiliary storage area at the front of the bag. This storage area is within the rectangular cross section of the bag so that two bags of this type can be placed side by side on a cart. There is no need to provide clearance between the bags for external storage area, such as pouches the can bulge when completely filled. This storage area is relatively deep at the base, creating space for large items, such as golf shoes, and tapers gradually toward the top of the bag where smaller items, that may be needed with greater frequency are stored.

This bag is also configured so that one club compartment is taller than the other. The shorter club compartment would be positioned toward the rear of the golf cart so that the shorter clubs is this compartment are accessible. Taller clubs, such as a driver and fairway woods are located in the taller compartment that will be located further from a golfer standing at the rear of the golf cart. The shorter clubs which comprise about two-thirds of a normal set, can be more easily inserted and removed because the top of the front club storage compartment is approximately ten percent lower than for a conventional golf bag.

DETAILED DESCRIPTION OF THE PREFERRED EMBODIMENTS

Figure 1:
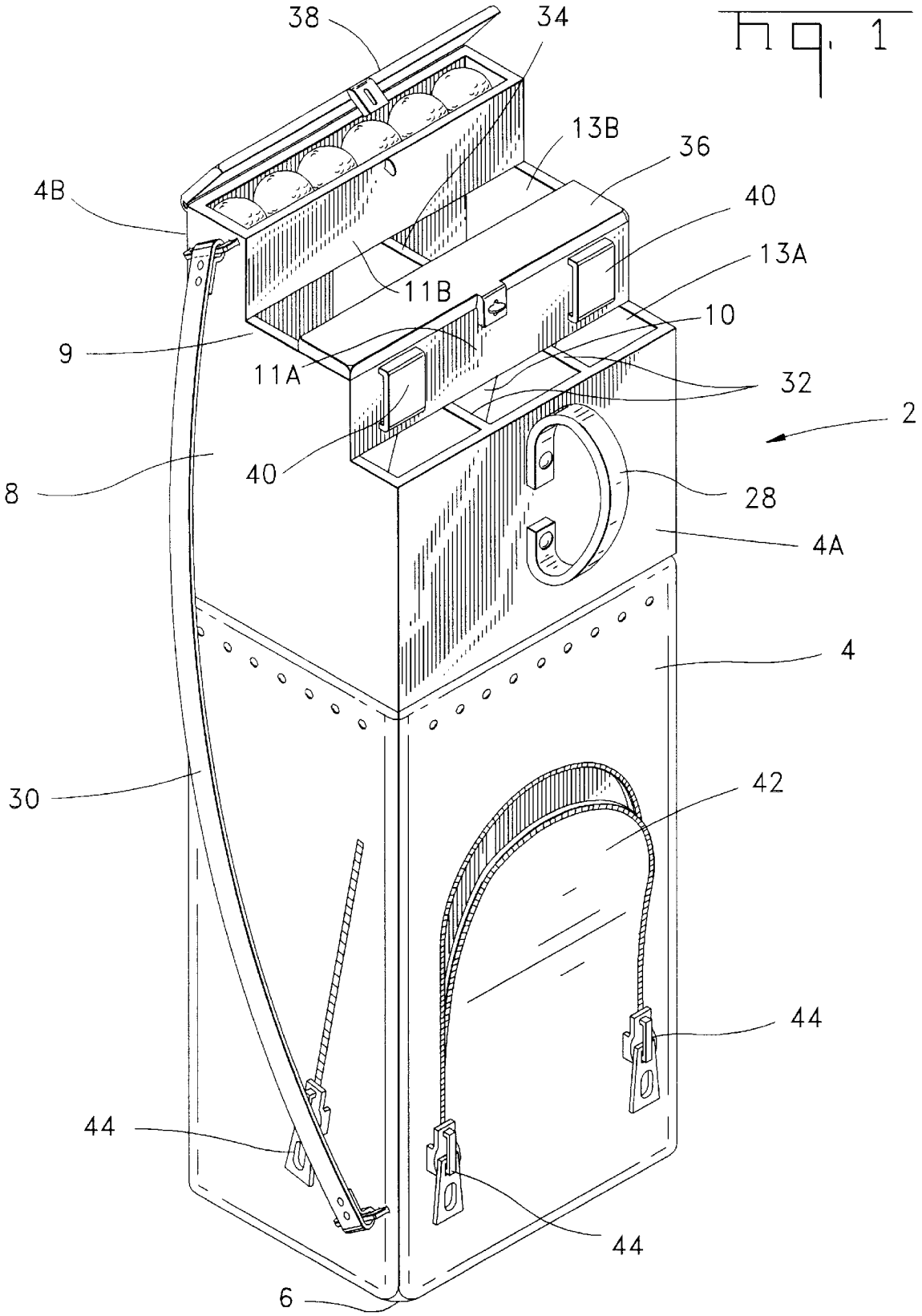
FIG. 1 is a perspective view of the preferred embodiment of this invention showing the two compartments in which golf clubs are to be positioned in two rows and showing the auxiliary storage compartments on the interior of this bag which has a rectangular cross section.
Figure 3:
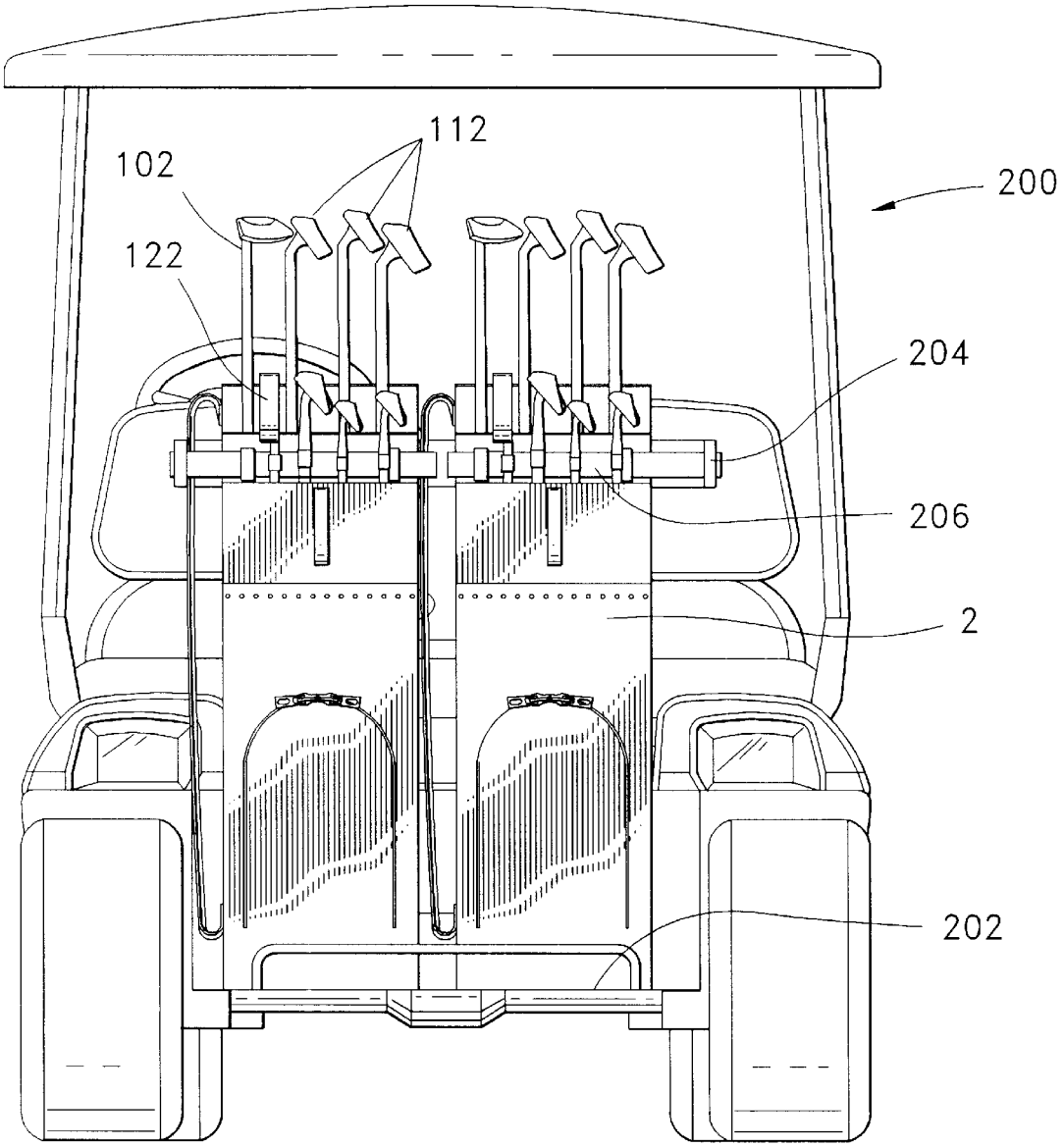
FIG. 3 is a view of a conventional powered golf cart with two golf bags positioned side by side on the cart. This figure shows the preferred embodiment of this invention.

The preferred embodiment of this invention is the golf bag 2 shown in FIG. 1. This golf bag 2 has a rectangular cross section instead of the generally circular cross section of more conventional right circular cylindrical golf bags. The preferred embodiment of this invention has a width of twelve inches and a depth of nine inches. These dimensions yield a bag having greater cross sectional area than a standard right circular cylindrical bag having a diameter of nine inches. Two rectangular bags having these dimensions will fit side by side on the bag support platform 202 at the rear of a conventional golf cart 200 as shown in FIG. 3.

Golf bag 2 is intended to sit in an upright position and comprises an outer shell or casing 4 extending between a base 6 and a top section 8. The shell 4 can be formed of a rigid material such as plastic giving the bag its structural integrity or it can comprise a fabric or leather covering surrounding an internal frame. Similar materials and manufacturing techniques can be used for the shell 4 and the shell or casing of a conventional golf bag. Shell 4 has four generally planar sidewalls extending between the base 6 and the top section 8. Normally the corners and edges of the bag 2 will be curved, rounded or tapered or faired to form a smooth and attractive appearance and these minor deviations from a geometrically perfect rectangular cross section should be considered inconsequential. The front wall 4A of the golf bag 2 has a height that is less than the height of the rear wall 4B. In the preferred embodiment of FIG. 1, the front wall 4A has a height of thirty one inches and the rear wall 4B has a height of thirty seven inches. The height of the front wall 4A is therefore less than the height of a standard golf bag so that it will not be necessary to raise a golf club to the same height when it is removed from golf bag 2. This would be true even if the golf club were lifted vertically to remove the club. However, it is not necessary to raise a golf club vertically to remove it from golf bag 2. All references to the front and rear of the golf bag used herein will be with respect to the front and rear as seen in FIG. 1. This relationship will be used even though the front of the golf bag may face rearwardly when mounted on golf cart 200 as shown in FIG. 3.

Figure 2:
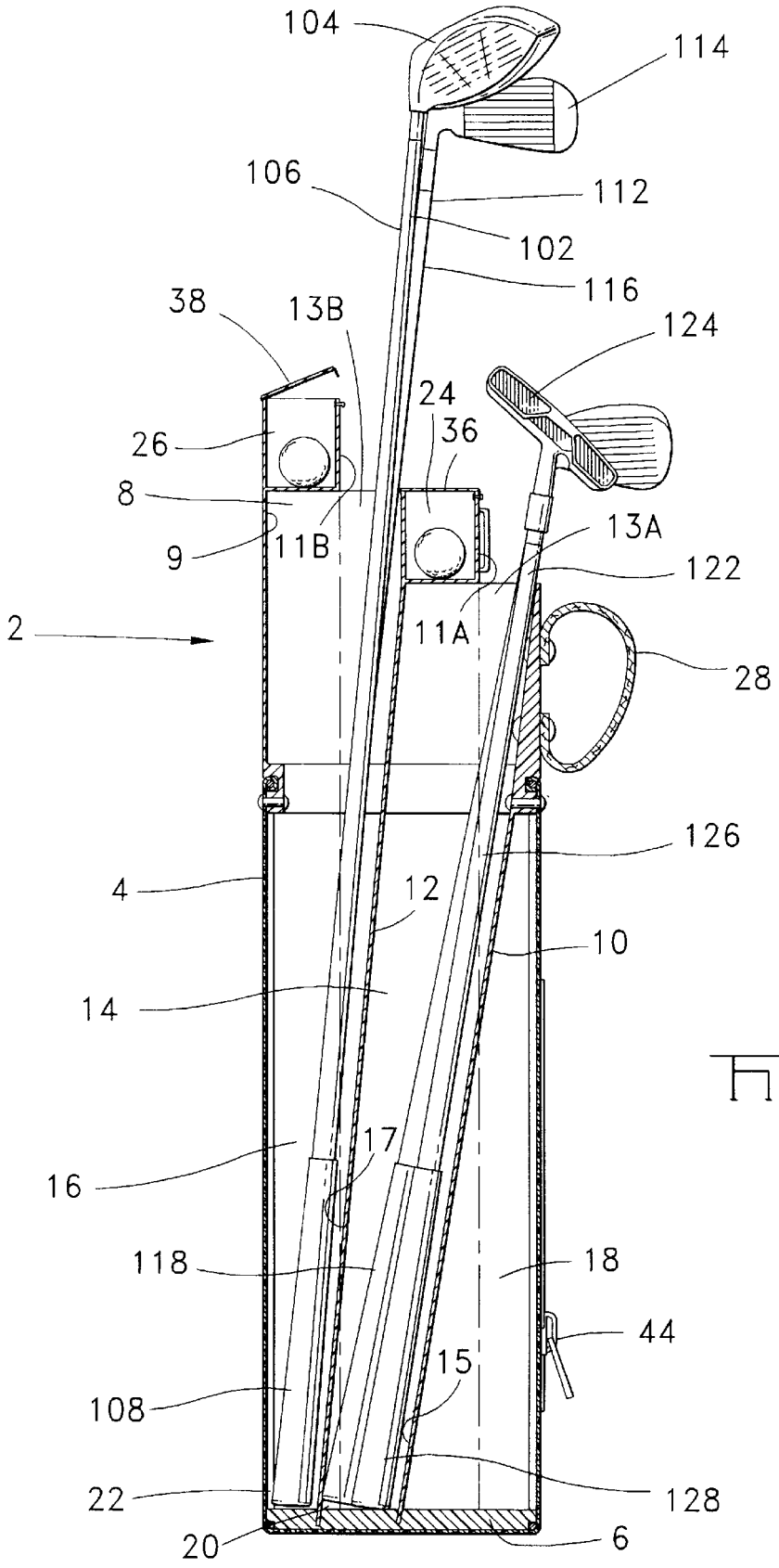
FIG. 2 is a sectional view of a golf bag according to the preferred embodiment of this invention showing that golf clubs positioned in this bag are inclined or tilted when the bag is in an upright position as it would be mounted on a conventional powered golf cart.

As seen in the side sectional view of FIG. 2, golf bag has a front internal divider wall 10 and a rear internal divider wall 12 which are spaced apart to form a front golf club storage compartment or area 14 and a rear golf club storage compartment or area 16. These two club storage compartments 14 and 16 and the two internal divider walls 10 and 12 are inclined relative to the major axis of the golf bag, which extends perpendicular to the base 6. The major axis of the golf bag 2 will extend vertically when the golf bag 2 is mounted in upright as shown in FIG. 3. The golf club compartments 14 and 16 will therefore be tilted, slanted or inclined relative to the vertical when the golf bag 2 stands upright. Golf clubs, such as wood clubs 102, iron clubs 112, and putters 122 will therefore be tilted, slanted or inclined relative to the vertical when the golf bag 2 stands upright. These golf clubs will tilt toward the front of the golf bag 2 and golf clubs positioned at an angle can be more easily removed from the golf bag 2.

The top section 8 of golf bag 2 has a peripheral wall 9 that has a stepped configuration because of discrete changes in the height of the golf bag 2 between the front face 4A and the rear face 4B. A front barrier 11A and a rear barrier 11B extend parallel to the front and rear walls 4A and 4B and form internal walls spaced from the peripheral wall 9. A front gap or opening 13A communicating with the front club storage compartment 14 and a rear gap or opening 13B communicating with the rear club storage compartment 16 are formed by these front and rear barriers 11A and 11B. In the embodiment shown in FIG. 2, the cross sectional area of these gaps or openings 13A and 13B is less than the cross sectional area of the club storage areas 14, 16, at least in the upper portions thereof, but each gap or opening 13A and 13B has sufficient area to permit golf clubs to be inserted and removed through the openings 13A and 13B. Since a typical set of golf clubs includes fourteen clubs and since there are two club storage compartments, the openings 13A and 13B would have a cross sectional area at least sufficient to receive the shafts and grips of seven golf clubs, even though for the sake of clarity, fewer clubs are shown in FIG. 3. Preferably the openings would be larger since it would not be uncommon for a golfer to carry a larger number of clubs and to also carry implements such as ball retrievers, umbrellas, and other equipment.

Barriers 11A and 11B are each three inches high in the preferred embodiment of this invention and provide space for a front secondary storage compartment 24 and a rear secondary storage compartment 26. These secondary storage compartments are useful for carrying golf balls, golf tees and other small items in an easily accessible location. In the embodiment shown in FIG. 2, the rear golf club storage compartment 16 tapers toward the base 6 and a restricted section 22 is formed between the divider 12 and the rear wall 4B of the golf bag 2 adjacent to base 6. This restricted area 22 is still large enough to provide room for the grips 108, 118 or 128 that may be stored in this rear club storage compartment 16. The section 20 at the bottom of the front club storage compartment 14 may have the same cross sectional area as the remainder of the front club storage compartment 14 as shown in FIG. 2 or it too may be smaller. However the location of the intersection of the divider walls 10, 12 with the base 6 is laterally offset with respect to the corresponding barrier 11A, 11B at the top of the golf bag, as shown by the dashed lines in FIG. 2. In other words the location of the intersection of the divider wall 10 with the base 6 is closer to the rear of the golf bag 2 than the barrier 11A located at the top of the front club storage area. Similarly the location of the intersection of the divider wall 12 with the base 6 is also closer to the rear wall of the golf bag 2 than the corresponding barrier 11B at the top of the rear club storage compartment 16. Therefore any golf club inserted into these storage areas 14, 16 must tilt toward the front wall of the golf bag because the grip 108, 118 or 128 will be behind the upper portion of the corresponding club shaft 106, 116 or 126. Since the center of gravity of the wood golf club heads 104 and the iron golf club heads 114 will be laterally offset relative to the corresponding shaft, the club heads 104, 114 will thus naturally tend to slope down and toward the front of the golf bag if the shaft is tilted or angled or inclined forward. These clubs will therefore be aligned with the club heads side by side instead of with club heads extending in many directions with larger clubs obscuring smaller clubs as in typical conventional golf bags. Many putters will also tend to be oriented in this manner, although some center shafted and center weighted putters, such as putter 122 with center shafted putter head 124 may tend to orient themselves in either of two positions. This orientation achieved by slanting the clubs even while the golf bag 2 is upright makes it easier to remove the clubs, easier to insert the clubs, easier to keep each club in a proper order, easier to see and select the appropriate club, and eliminates entanglement of the clubs. Although the bottom of the dividers in this preferred embodiment is laterally offset from the opening or gaps at the top, the dividers can be positioned so that they are laterally even with the openings at the top because the thickness of the grips will cause the clubs to be at least slightly slanted.

In addition to the club storage areas 14 and 16 on the interior of the golf bag 2, inclined front divider 15 also creates an auxiliary storage compartment 18 accessible from the front of the golf bag 2 adjacent the base 6. This auxiliary storage compartment 18 will always be accessible from the rear of a golf cart 200 when the golf bag 2 is oriented in the manner shown in FIG. 3. This auxiliary storage compartment 18 is completely within the rectangular cross section of the golf bag 2 and does not protrude like pouches on the sides of a conventional golf bag. As shown in FIG. 1, zippers 44 or other standard fasteners provide access to the auxiliary storage compartment 18 through a flap 42. Sufficient space is provided in compartment 18 for larger items, such as shoes and foul weather gear and the absense of protruding pouches makes it easier to position two of these relatively larger bags 2 side by side on a golf cart. In some cases, two bags can even be positioned with the front of the bag facing sideways and outwardly so that the shorter front faces sideways for easier access to the clubs from the side. To insure access to the auxiliary compartment 18 when the bag 2 is mounted on a golf cart in this manner, zippered openings can also be provided on the side of the bags.

A handle 28 is located on the front of the bag 2 where it can be grasped to lift the golf bag 2 onto or off of the bag support platfrom 202 on cart 200. A shoulder carrier strap 30 is attached to one side of bag 2 to assist in carrying the bag. Loops 40 can also be located on the front of barrier wall 11A for receipt of a bag strap restraint 206 on cart 200. These loops 40 are provided because in some instances the front wall of the bag may be lower than the bag restraint cradle 204 on some conventional carts. Bag 2 also includes auxiliary separators 32 and 34 extending transversely relative to barriers 11A and 11B and through openings 13A and 13B to provide some side to side separation between the clubs. More separators can be provided or separators can be eliminated because of the natural tendency of the clubs to align themselves. Separators 32 and 34 should however facilitate insertion of clubs into the golf bag 2 by keeping the shafts relatively straight therefore providing more than adequate space for the grips of side by side clubs. Covers 36, 38 can also be provided for the secondary storage compartments at the top of the golf bag 2.

Figure 4:
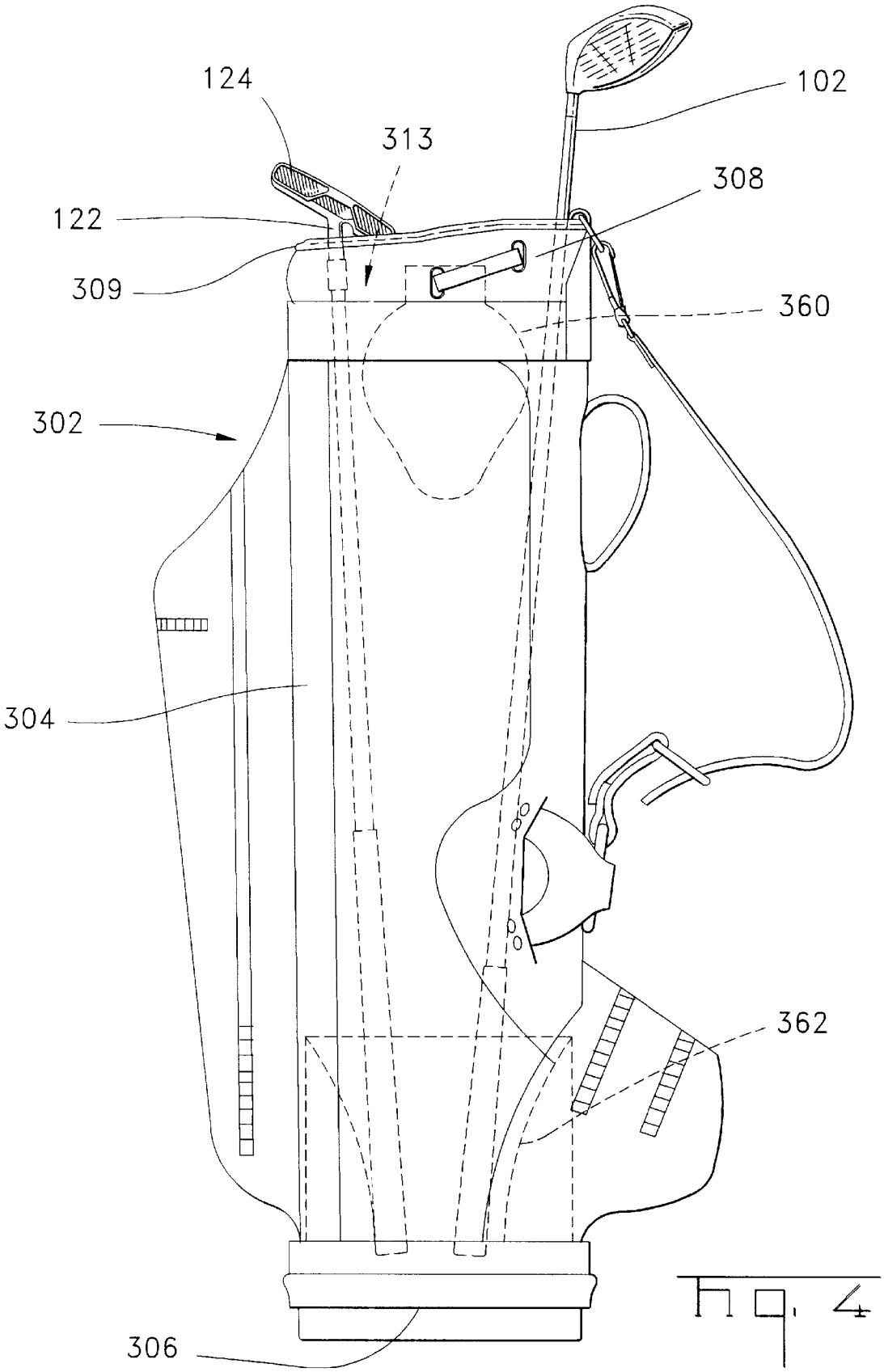
FIG. 4 is a view of an alternative embodiment of this invention adapted for use with a golf bag having a circular or oblong cross section.

A second embodiment of a golf bag 302 in which the golf clubs are positioned in an inclined position when the bag is in an upright position is shown in FIG. 4. Golf bag 302 has a shell 304 that has a circular cross section so that the golf bag has a body in the form of a right circular cylinder. The top section 308 of the bag has a peripheral wall 309 that is generally circular. A central obstruction 360 located in the top section spaced from peripheral wall 309 has a tapered lower section and forms a radially extending opening or gap 313 through which club shafts are inserted. Bag 302 has divider walls extending from the top section 308 to the base 306 that divide the bag into separate club storage compartments. A tapered insert 362 is located at the bottom of the internal storage space. Insert 362 has a cylindrical outer surface and a generally conical inner surface tapering inwardly from the top of the insert to the bottom of the insert where the insert 362 intersects the upper surface of base 306. This point of intersection is located so that the centerline of the golf clubs 102, 122 shown positioned in the bag will be spaced radially inward relative to the radial gap 313 at the top of the bag. The clubs will therefor be tilted or inclined radially outward and the club heads will therefore naturally face radially outward. Although the intersection between the top surface of the base 306 and the bottom of the tapered insert 362 can be located radially inward relative to the exterior of central obstruction 360, it need not be to cause the clubs to the tilted. The thickness of the grips on the golf clubs will occupy some space so the centerline of the grips can be located radially inward of the exterior surface of the obstruction 360 so that the clubs must be slanted. Central obstruction 360 and insert 362 can be inserted into a standard golf bag by removing the normal separators located at the top of most conventional golf bags.

The two embodiments of this invention shown in FIGS. 1–4 are only representative of golf bags incorporating this invention. For example, the bags need not have either a rectangular or a circular cross section. The rectangular bag 102 has been dimensioned so that the golf clubs face rearwardly when placed on a conventional cart. However, the dimensions of the bag can be changed so that it will fit on a conventional cart with the clubs facing sideways. A square bag that can be positioned in either orientation can also be used.

Another alternative to the embodiment shown in FIG. 1 is to employ internal dividers that do not extend the entire length of the bag. For example, slanted internal divider walls located at the top of the bag and extending only part way down the bag can be sufficient to insure that the clubs will be inclined when the bag is in the upright position. Another option would be to slant the top surface of the base so that the grips on the clubs will be urged toward the taller side of the bag to tilt the clubs.

The golf club storage compartments also do not need to be rectangular so that the clubs are positioned side by side. For example these compartments could have an arcuate or crescent shaped.

These and other modifications could be incorporated into a golf bag in accordance with this invention and the following claims are intended to cover the representative embodiments described herein and modifications and equivalent structures that would be apparent to one of ordinary skill in the art.

I claim:

1. A golf bag for use with a set of golf clubs, each golf club having a club head attached to one end of a shaft and a grip located on an opposite end of the shaft:

the golf bag having a major axis and comprising an outer shell extending axially between a closed base and a open top section, the open top section having a peripheral wall;

the shell, the base and the open top section defining an interior space sufficient to receive the shafts of a set of golf clubs with the club heads of the golf clubs protruding above the top section of the golf bag;

the bag including a barrier positioned within the top section, the barrier having at least one edge spaced laterally from the peripheral wall on the top section to form a gap through which the club shafts may be inserted into the bag, the cross sectional area of the gap being less than the cross sectional area adjacent the top of the interior space with which the gap communicates;

the bag further including at least one inclined surface extending upwardly from the base of the golf bag on the interior of the golf bag, the inclined surface intersecting the base at a position laterally offset relative to the gap at the top of the golf bag so that the shafts of each club must extend at an angle relative to the major axis of the golf bag, and the club heads of the inclined clubs will tend toward a common orientation due to the weight of the club heads when the major axis of the bag is vertical, the common orientation of the clubs aligning the clubs in the bag so that the club heads will not become entangled.

2. The golf bag of claim 1 wherein the common orientation of the club heads is in at least one row extending transversely relative to the major axis of the bag, and wherein the golf bag has a rectangular cross section.

3. The golf bag of claim 1 wherein the common orientation of the club heads is radially outward and the golf bag is cylindrical with an arcuate cross section.

4. The golf bag of claim 3 wherein the inclined surface extending upwardly from the base of the golf bag is a truncated conical surface tapered inwardly toward the base and wherein the barrier at the top section of the golf bag comprises a member obstructing the center of the top section of the golf bag.

5. A golf bag for use in carrying a set of golf clubs in a golf cart with the golf bag in an upright position and with the golf clubs inclined relative to a vertical axis to facilitate selection of individual golf clubs and simplify removal of individual golf clubs from the bag, the golf bag comprising an outer shell extending between a base and an open top section and forming an interior space sufficient to store the golf clubs with club heads of individual golf clubs protruding above the open top section, and at least one internal divider extending downward from the open top section, the internal divider being inclined relative to an axis extending perpendicular to the base of the golf bag, the internal divider extending downward for a distance sufficient to maintain shafts of each individual club inclined relative to the axis perpendicular to the base so that each club head will be oriented in a common direction, the open top section including at least one laterally extending barrier forming gaps through which the golf club shafts can extend, the cross sectional area of all gaps formed in the open top section being less than the cross sectional area adjacent the top of all interior.

6. The golf bag of claim 5 wherein the internal divider separates the interior space into two golf club storage compartments.

7. The golf bag of claim 6 wherein the two golf club storage compartments are side by side to position golf clubs in each golf club storage compartment side by side in rows.

8. The golf bag of claim 7 wherein the golf bag and the golf bag shell have a rectangular cross section.

9. The golf bag of claim 8 wherein the golf bag has a front exterior wall and a rear exterior wall, the height from the base to the top section of the rear exterior wall being greater than the height of the front exterior wall.

10. The golf bag of claim 8 wherein the golf bag includes an auxiliary storage compartment separated from one golf club storage compartment by an internal wall.

11. The golf bag of claim 10 wherein the auxiliary storage compartment is adjacent to a front wall of the golf bag.

12. The golf bag of claim 11 wherein the auxiliary storage compartment is within the rectangular cross section of the golf bag.

13. The golf bag of claim 11 wherein the bag includes a front and rear exterior walls, the front exterior wall being shorter than the rear exterior wall, and a handle is positioned on the shorter exterior wall.

14. The golf bag of claim 5 wherein the internal divider extends from the top section to the base of the golf bag.

15. The golf bag of claim 5 wherein the bag includes an auxiliary storage compartment accessible from the front of the golf bag for storage of golf equipment other than clubs and at least one secondary storage compartment accessible from the top of the golf bag for storage of smaller items, both the auxiliary storage compartment and the secondary storage compartment being accessible from the rear of a golf cart on which the golf bag can be mounted without movement of the golf bag.

16. A golf bag for use in carrying a set of conventional golf clubs in a golf cart with the golf bag in an upright position and with all of the golf clubs in the golf bag inclined relative to a vertical axis in a front and a rear row to facilitate selection of individual golf clubs and simplify removal of individual golf clubs from the bag, the bag having a base and a top and having a rectangular cross section with a front wall that is shorter than a rear wall, the height of each wall being less than the length of conventional golf clubs, the bag including two internal divider walls inclined relative the vertical axis and extending from a base to the top of the bag, the two internal divider walls forming two golf club shaft storage compartments, the bag further including front and rear rectangular barriers in the top of the bag, the front and rear barriers forming two parallel rectangular gaps at the top of the bag, each gap communicating with one of the golf club shaft storage compartments and constricting entrance to the corresponding golf club shaft storage compartment so as to restrict the cross sectional area of the corresponding golf club shaft storage compartment, at the top of the bag, sufficiently to force golf clubs in each golf club shaft storage compartment to be aligned in a row with the golf clubs being inclined toward the front of the golf bag.

17. The golf bag of claim 16 wherein the front and rear barriers comprise front and rear secondary storage compartments.

* * * * *